US006216717B1

(12) United States Patent
Chen

(10) Patent No.: US 6,216,717 B1
(45) Date of Patent: Apr. 17, 2001

(54) COLLAPSIBLE TENT FRAME

(75) Inventor: Jing-Cai Chen, Guangdong (CN)

(73) Assignee: Sing Sing Fibers Industry Co., Ltd., Walnut, CA (US)

( * ) Notice: Subject to any disclaimer, the term of this patent is extended or adjusted under 35 U.S.C. 154(b) by 0 days.

(21) Appl. No.: 09/407,016

(22) Filed: Sep. 28, 1999

(51) Int. Cl.[7] ..... E04H 15/38
(52) U.S. Cl. ..... 135/130; 135/122
(58) Field of Search ..... 135/128, 121, 135/122, 129, 130, 131, 143, 144, 151

(56) References Cited

U.S. PATENT DOCUMENTS 2,153,547 * 4/1939 Charlop et al. ..... 135/121
2,334,435 * 11/1943 Patterson et al. ..... 135/122
2,511,974 * 6/1950 Finken et al. ..... 135/122
3,469,587 * 9/1969 Folkes ..... 135/130 X
4,607,656 * 8/1986 Carter ..... 135/122 X
5,327,927 * 7/1994 Oh ..... 135/128 X
5,343,887 * 9/1994 Danaher ..... 135/128 X
5,590,674 * 1/1997 Eppenbach ..... 135/130 X
5,701,923 * 12/1997 Losi, Jr. et al. ..... 135/131
5,944,040 * 8/1999 Jang ..... 135/131 X
6,067,676 * 5/2000 Carnahan et al. ..... 135/128 X

* cited by examiner

*Primary Examiner*—Peter M. Cuomo
*Assistant Examiner*—Hanh V. Tran
(74) *Attorney, Agent, or Firm*—Dellett and Walters

(57) ABSTRACT

A collapsible tent frame is disclosed. The collapsible tent frame includes a polygonal framework having a plurality of joints arranged at corners thereof and a plurality of rail pole assemblies interconnecting the joints respectively, at least three leg pole assemblies extending downward from the joints of the polygonal framework and a roof framework having a plurality of rafter pole assemblies connected to the joints of the polygonal framework. The pole assemblies can be shortened when the collapsible tent frame is to be collapsed.

9 Claims, 7 Drawing Sheets

COLLAPSIBLE TENT FRAME

BACKGROUND OF THE INVENTION

1. Field of the Invention

The present invention relates to a tent frame and, more particularly to a collapsible tent frame which has excellent stability when in use.

2. Description of Related Art

A collapsible tent frame can be unfolded for use and folded for easy storage. Such a tent frame, for example, is disclosed in CHINA Pat. No. 95,231,518 in which a square framework is made up of four telescopic rail pole assemblies, with telescopic leg pole assemblies extending therefrom for supporting the framework above the ground. Moreover, each of the leg pole assemblies is pivotally connected to the framework so as to be pivotal to a position alongside one of the leg pole assemblies.

The square framework can be collapsed by first folding the framework diagonally. The resulting V is then folded up so that the two parts of the V are pivoted toward each other around a bottom end thereof, until the four rail pole assemblies are arranged one alongside another. Finally, the pole assemblies, including the rail pole assemblies and the leg pole assemblies, are retracted. As a result, the framework is configured like a compact column.

However, the disclosed tent frame is not stable when in use, since all of the pole assemblies thereof are telescopic.

Therefore, it is an objective of the invention to provide a collapsible tent frame to mitigate and/or obviate the aforementioned problem.

SUMMARY OF THE INVENTION

The object of the present invention is to provide a collapsible tent frame which has excellent stability when in use.

Other objects, advantages and novel features of the invention will become more apparent from the following detailed description when taken in conjunction with the accompanying drawings.

DETAILED DESCRIPTION OF THE PREFERRED EMBODIMENT

Figure 1:
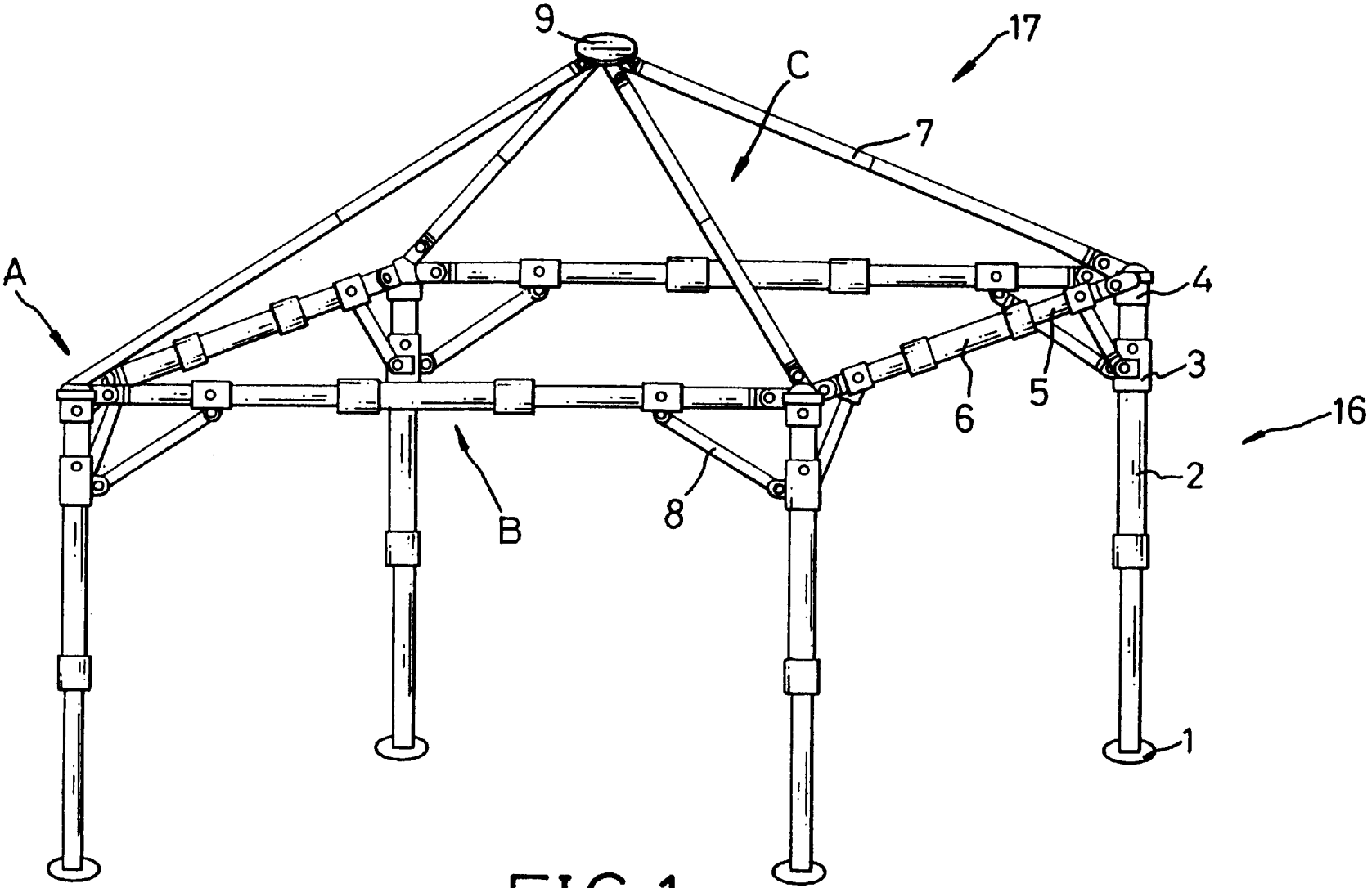
FIG. 1 is a top perspective view showing a preferred embodiment of a collapsible tent frame in accordance with the present invention in an unfolded position.

Referring to FIG. 1, a preferred embodiment of a collapsible tent frame in accordance with the present invention includes a polygonal framework (16), a plurality of leg pole assemblies (2) for supporting the framework (16) above the ground, and a roof framework (17) atop the framework (16).

The polygonal framework (16), preferably rectangular in shape as shown, has joints (4) arranged at corners thereof and rafter pole assemblies (7) interconnecting the joints (7), with the leg pole assemblies (2) extending downward substantially vertically, or alternatively downward and outward, from the joints (4). In the illustrated embodiment, each of the leg pole assemblies (2) has a disk (1) formed at the lower end thereof, and consists of two telescopic tubes, being operable to be shortened in a manner of retraction when the collapsible tent frame is to be collapsed.

The roof framework (17) is made of a plurality of rafter pole assemblies (7) attached to the joints (4) of the rectangular framework (16). The rafter pole assemblies (7) have respective top ends attached in articulation to a common joint (9), thus configuring the roof framework (17) in a pyramidal shape.

In addition, the collapsible tent frame of the present invention preferably includes a plurality of inclined struts (8), each having a first end pivotally connected to a corresponding one of the rail pole assemblies (5) and a second end movable along one of the leg pole assemblies (2), such as by way of a tubular member (3) movably mounted around the pole assembly (2).

Figure 2:
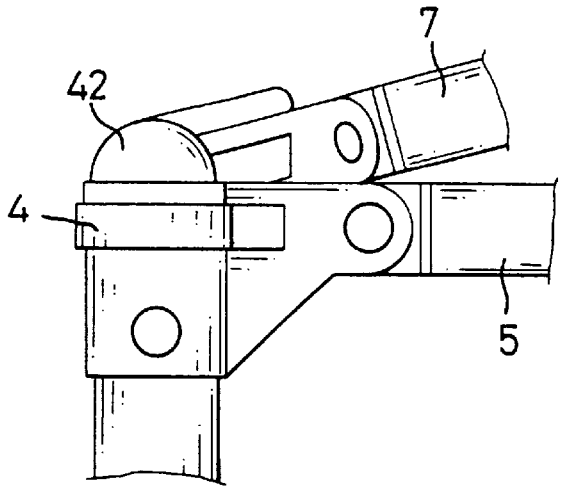
FIG. 2 is an enlarged perspective view of a joint shown at A of FIG. 1.
Figure 3:
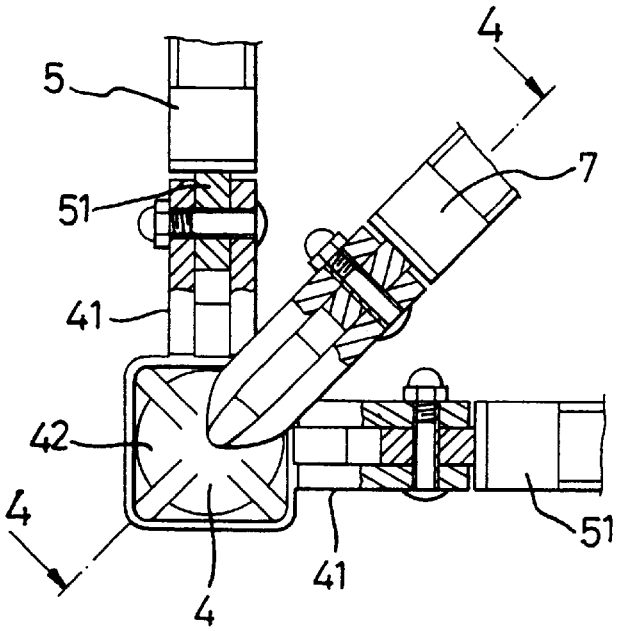
FIG. 3 is a top view of the joint of FIG. 2.
Figure 4:
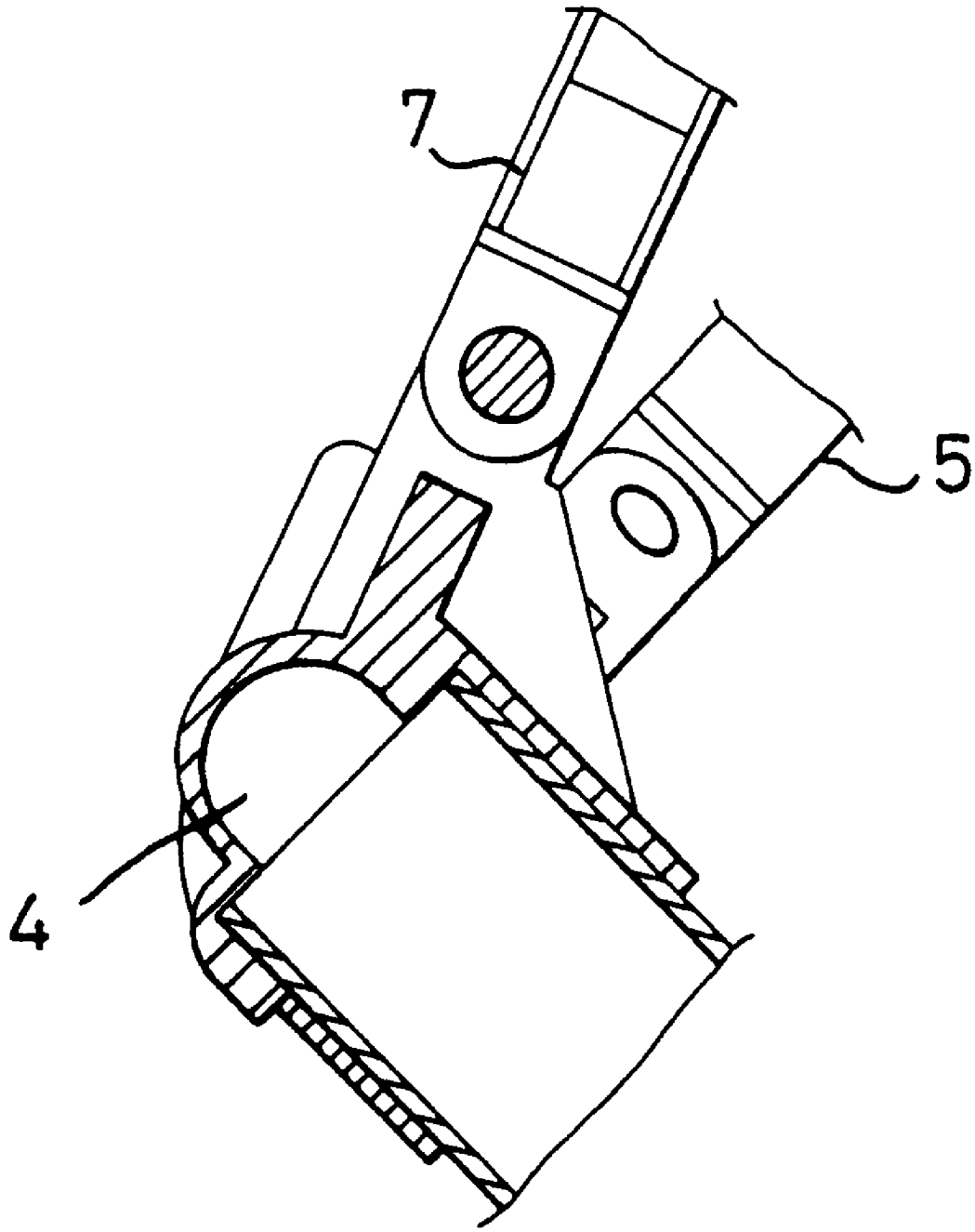
FIG. 4 is a cross-sectional view of the joint taken along lines A—A in FIG. 3.

Referring to FIGS. 2 to 4, the joints (4) of the rectangular framework (16) each have two lateral lugs (41) for pivotally connecting two of the rail pole assemblies (5), and a hemi-spherical articulator (42) arranged at the top thereof for attaching one of the rafter pole assemblies (7).

Figure 5:
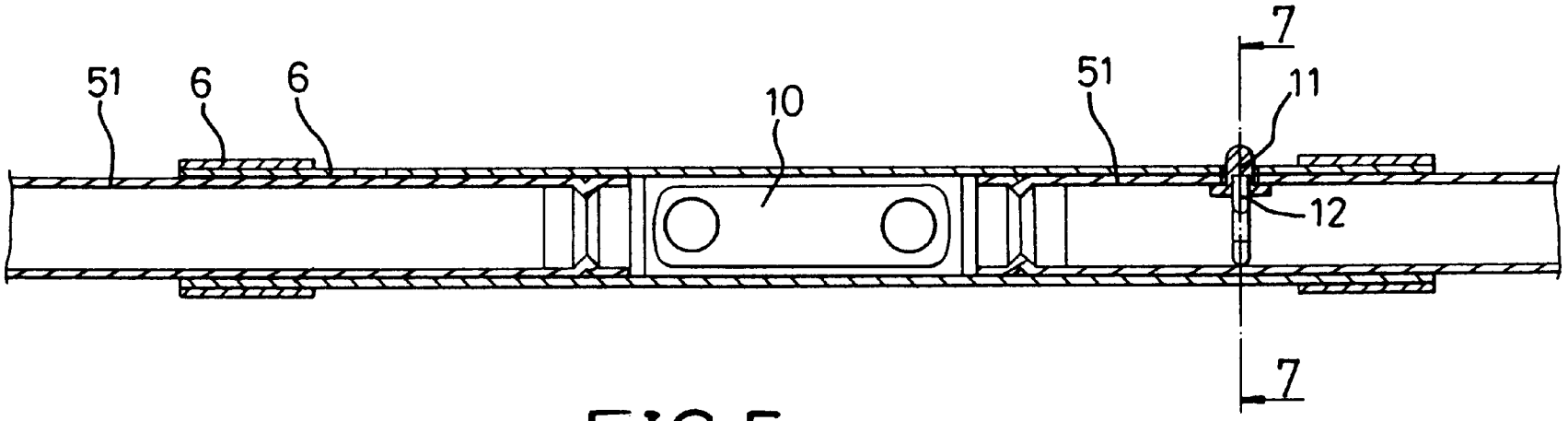
FIG. 5 is a fagmentary cross-sectional view of a rail pole assembly used in the collapsible tent frame of FIG. 1.
Figure 6:
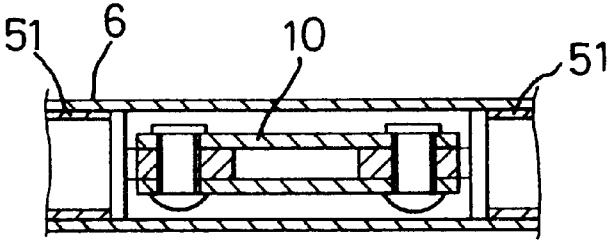
FIG. 6 is a fragmentary cross-sectional top view of the rail pole assembly shown in FIG. 5.
Figure 7:
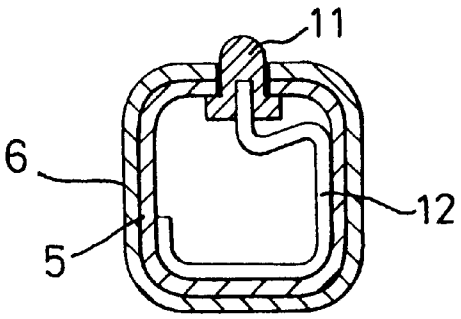
FIG. 7 is a transverse cross-sectional view of the joint taken along lines B—B in FIG. 5.
Figure 8:
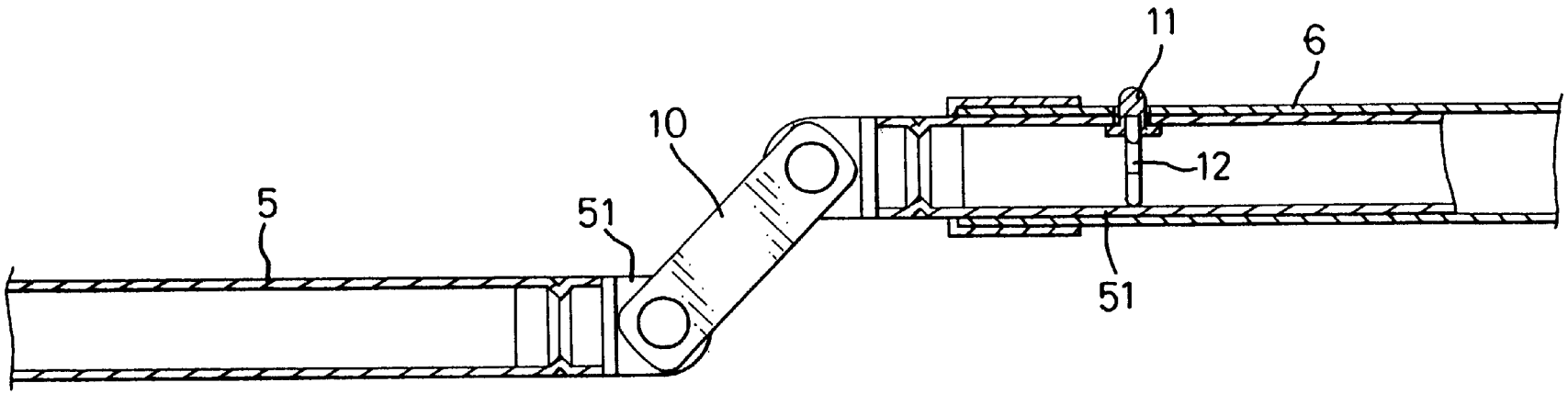
FIG. 8 is a cross-sectional view showing the rail pole assembly in a folded position.

Referring to FIGS. 5 to 8, each of the rail pole assemblies (5) has two bars (51) pivotally connected at first ends thereof to respective joints (4), as clearly shown in FIGS. 2 to 4, and at second ends thereof with each other, preferably through a short connector (10) that has opposite ends pivotally connected with respective second ends of the two bars (51), as shown in FIGS. 5 and 8. In this configuration, the rail pole assembly (5) is operable to be shortened in a manner of folding when the collapsible tent frame is to be collapsed.

The connector (10) mentioned above may be configured as two pieces (11) arranged on opposite sides of the bars (51) and pivotally connected with the second ends of the two bars (51), as best shown in FIG. 6.

When the collapsible tent frame is in an unfolded position, the two bars (51) of the rail pole assembly (5) are maintained in alignment, by means of a sleeve (6) mounted around the rail pole assembly (5) and movable to be positioned at the juncture between the two bars (51). The sleeve (6) can be retained in this position relative to the bars (51), as shown in FIG. 5, such as by a protrusion (11) snapping into a hole (not numbered) defined in the sleeve (6) under the action of a spring (12), as shown in FIG. 7.

The rail pole assembly (5) can be folded up, with one of the bars (51) thereof alongside the other, once the sleeve (6) is moved away from the juncture between the bars (51).

Figure 9:
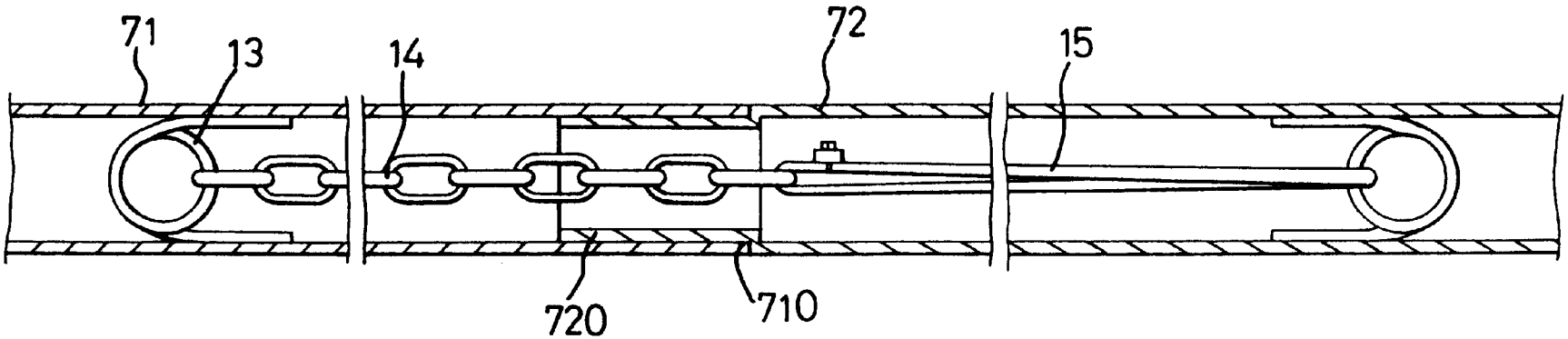
FIG. 9 is a fragmentary cross-sectional view of a rafter pole assembly used in the collapsible tent frame of FIG. 1.
Figure 10:
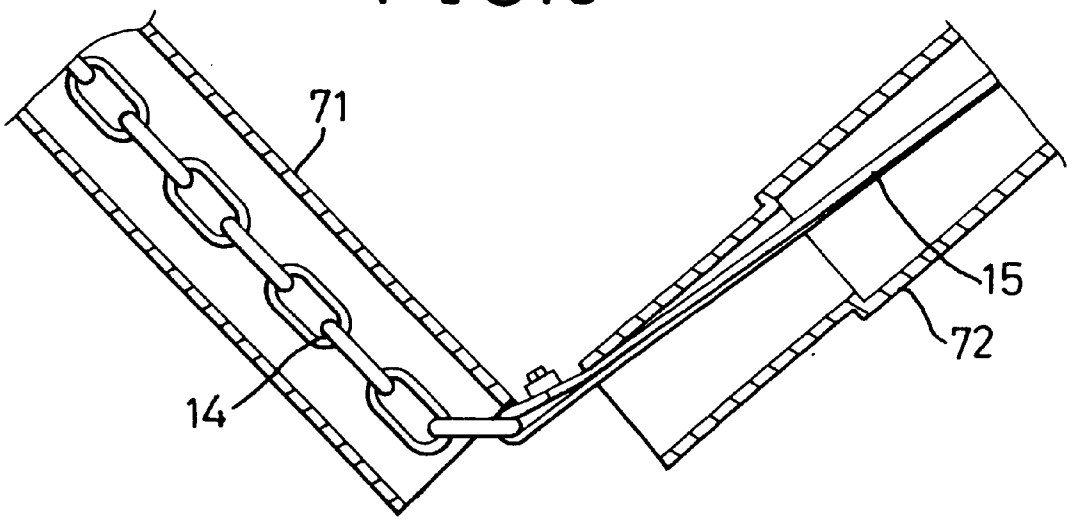
FIG. 10 is a cross-sectional view showing two separate parts of the rafter pole assembly shown in FIG. 9.

Referring to FIGS. 9 and 10, the rafter pole assemblies (7) each includes a firs tube (71) and a second tube (72) detachably connected to the first tube (71).

The first tube (71) has a female end (710), and the second tube (72) has a male end (720) configured to mate with the female end (710) of first tube (71). The rafter pole assembly (7) is extended by inserting the male end (720) of the second tube (72) into the female end (710) of the first tube (71) when the collapsible tent frame is to be unfolded. The rafter pole assembly (7) is also shortened by removing the male end (720) of the second tube (72) from the female end (710) of the fist tube (71) when the collapsible tent frame is to be collapsed.

In each of the rafter pole assemblies (7) at positions adjacent to the juncture of the two tubes (71, 72) thereof, there are two coil springs (13), the first of which is secured in the first tube (71) and attached to a chain (14), and the second is secured in the second tube (72) and attached to an elastic band (15). The chain (14) and the elastic band (15) are dimensioned and connected so a to prevent the male end (720) of the second tube (72) unintentionally escaping from the female end (710) of the first tube (71), but allow a user to move the male end (720) out the female end (710) against the action of the band (15), for the purpose of folding the rafter pole assembly (7) when the collapsible tent frame is to be collapsed.

Figure 11:
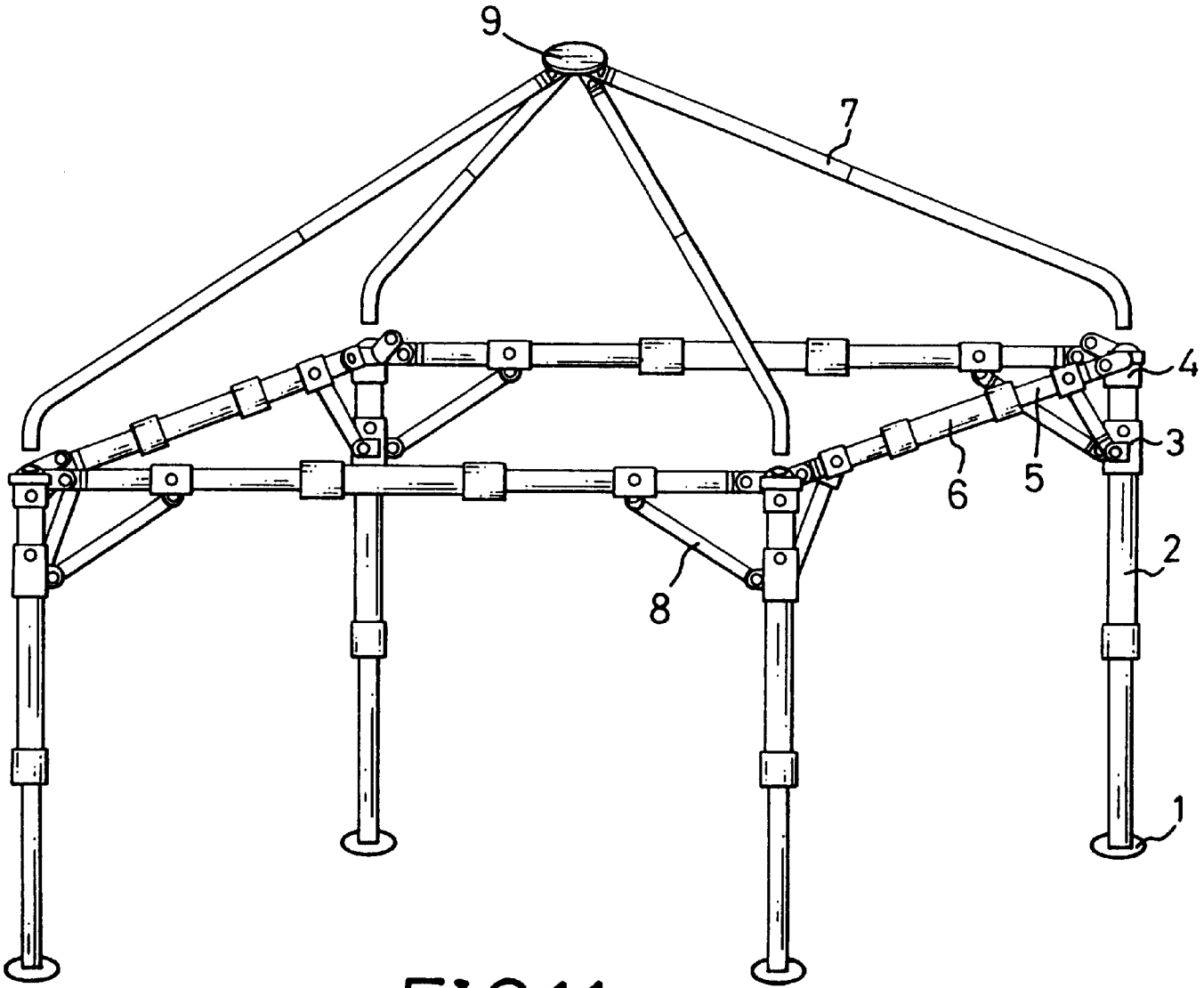
FIG. 11 is a perspective view of another preferred embodiment of the invention.

Referring to FIG. 11, in an alternative preferred embodiment of the present invention, a rectangular framework (16') is formed with four joints (4') having respective bores (42') defined in the top faces thereof, while a roof framework (17') has four rafter pole assemblies (71') adapted to be inserted in the bores (42') of the joints (4'). Therefore, the frameworks (16', 17') can be folded separately, once the rafter pole assemblies (7') of the roof framework (17') are disengaged from the joints (4') of the rectangular framework (16').

The invention has the advantage of excellent stability when in use.

It is to be understood, however, that even though numerous characteristics and advantages of the present invention have been set forth in the foregoing description, together with details of the structure and Function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A collapsible tent frame, comprising:

a polygonal framework (16) having a plurality of joints (4) arranged at corners thereof and a plurality of rail pole assemblies (5) interconnecting said joints (4) respectively;

at least three leg pole assemblies (2) extending downward from said joints (4) of said polygonal framework (16);

a roof framework (17) configured in a pyramidal shape and having a plurality of rafter pole assemblies (7) connected to said joints (4) of said polygonal framework (16), each said rafter pole assembly (7) including at least two tubes (71,72) detachably connected one by one, a pair of coil springs (13), a chain (14) and an elastic band (15) at the juncture of said two tubes thereof, and wherein said rafter pole assemblies (7) have respective top ends pivotally joined together; wherein said pole assemblies (2, 5, 7) can be shortened when said collapsible tent is to be collapsed.

2. The collapsible tent frame as claimed in claim 1, wherein each of said leg pole assemblies (2) has at least two telescopic tubes, one sliding over another, thereby being operable to be shortened in a manner of retraction when said collapsible tent frame is to be collapsed.

3. The collapsible tent frame as claimed in claim 1, wherein each of said rail pole assemblies (5) has at least two bars (51) pivotally connected at first ends thereof to respective joints (4) and at second ends thereof with each other, thereby being operable to be shortened in a manner of folding when said collapsible tent frame is to be collapsed.

4. The collapsible tent frame as claimed in claim 3, wherein said at least two bars (51) of said rail pole assembly (5) are pivotally connected with each other, through a short connector (10) that has two ends pivotally connected with respective second ends of said two bars.

5. The collapsible tent frame as claimed in claim 4, wherein said short connector (10) is configured as two pieces (10) arranged on opposite sides of said two bars (51) and pivotally connected with said second ends of said bars (51).

6. The collapsible tent frame as claimed in claim 5, wherein said rail pole assembly (5) further includes a sleeve (6) mounted around said rail pole assembly (5) and movable to be positioned at the juncture between said two bars (51) thereof.

7. The collapsible tent frame as claimed in claim 1, wherein said rafter pole assemblies (7) are pivotally connected to said joint (4) of said polygonal framework (16).

8. The collapsible tent frame as claimed in claim 1 further including a plurality of inclined struts (8), each having a first end pivotally connected to one of said rail pole assemblies (5) and a second end movable along one of the leg pole assemblies (2).

9. The collapsible tent frame as claimed in claim 1, wherein said leg pole assemblies (2) extend downward vertically from said joints (4).

* * * * *